US005393579A

United States Patent [19]

Witte

[11] Patent Number: 5,393,579

[45] Date of Patent: Feb. 28, 1995

[54] DOME-LIKE FOLDED STRUCTURE

[76] Inventor: Paul Witte, 157 N. Main St., New Hope, Pa. 18938

[21] Appl. No.: 55,565

[22] Filed: May 3, 1993

[51] Int. Cl.[6] ..... A47G 33/08

[52] U.S. Cl. ..... 428/9; 428/11; 428/99; 446/488

[58] Field of Search ..... 428/9, 99, 11; 229/8; 446/488; 52/DIG. 10

*Primary Examiner*—Alexander S. Thomas

*Attorney, Agent, or Firm*—Gregory J. Gore

[57] ABSTRACT

A foldable construction incorporates both structural and ornamental qualities into a single form. The construction is made of a single, die-cut, nearly rectangular, blank of flat foldable material which is pre-creased with a unique configuration of fold lines. The completed structure is characterized by a convex dome shape on at least the top side. When folded to create a pair of opposing dome shapes, construction may take the form of a very solid, somewhat spherical, sculpture shape. Each dome is radially sectioned in an equal pattern around the axis of the dome and each section of the dome includes a recess portion which interrupts the outer skin and forms a structural rib. An internal support block may be used between the sets of structural ribs of the opposing domes to provide additional axial support. The resulting construction is extremely strong and it permits the use of paper as a folding material for ornaments which will compete with more sophisticated ornaments in the marketplace which are made of glass, wood or metal.

9 Claims, 5 Drawing Sheets

DOME-LIKE FOLDED STRUCTURE

FIELD OF THE INVENTION

This invention relates to making three-dimensional structures by folding flat sheet materials to form an article useful for decoration or, on a larger scale, an article used as a general purpose support structure. A specific embodiment includes the formation of a somewhat spherical hanging ornament formed by folding paper construction material.

BACKGROUND OF THE INVENTION AND DESCRIPTION OF PRIOR ART

The formation of three-dimensional shapes to create a building structural support which is formed from a plurality of individual panels is well-known. However, the formation of such large structures constructed from a single foldable sheet of material is uncommon. The field in which folded constructions are most widely used is small folded ornamental forms, traditionally using paper, which is an area pertinent to one embodiment of the present invention. Folded paper ornaments usually begin with flat, die-cut, sometimes prescored, geometric patterns to be folded into interesting shapes.

There are, however, many problems with these paper constructions. Paper ornaments generally emphasize the nature of the paper and often are folded into complicated, unstructured, somewhat flat configurations which are vulnerable to rumpling and are easily damaged. Prior art paper shapes that are folded into three-dimensional closed forms are inherently structurally weak and are vulnerable to being crushed during handling, storing or shipping. Furthermore, most three-dimensional constructions require complex-shaped blanks which dictate intricate folding and gluing methods to achieve the desired form. These are frequently offered as craft projects requiring do-it-yourself construction. Another problem is that paper ornaments or sculptured forms often reveal the edges of the construction material which-are thus more readily exposed to being torn or frayed. Therefore, folded paper forms of these constructions are generally perceived to be short-lived and are not considered high quality products that would compete with more sophisticated ornaments in the marketplace, such as glass, wood or metal.

The following U.S. Patents are the closest prior art of which the applicant is aware.

U.S. Pat. No. 4,492,723, entitled "Curvilinear Polyhedral Construction Kit", discloses a construction kit in which flat blanks may be folded into three-dimensional solid objects in which all surfaces are arcuate and clusters of polyhedrons. The methods and structures disclosed in this patent disregard ease of folding and assembly, and do not provide aesthetically pleasing shapes derived from folded engineered structure which would produce forms capable of the structural rigidity which the folded pattern of the present invention provides.

U.S. Pat. No. 3,799,425, entitled "Blank for Making Containers and Container with Top Formed by Curved Surfaces", discloses a container which can be formed from a single paperboard blank divided by fold lines. The container has a combination of single curved surfaces terminating in sharp edges and corners. The sharp edges result in a box-like container having a dome-shaped top. The top is held together by fastening together tabs which fall in the center of the top.

U.S. Pat. No. 4,712,725, entitled "Container with Integral Fold-In Closure Lid", discloses a container for dispensing foods and for storing articles which includes its own integrally-formed closure lid. The sides of the tapered cylindrical container are folded inward at the top along triangular fold lines which meet at the center to form a lid. The fold pattern does not provide a dome shape for external vertical structural integrity, but rather provides a concave top surface which facilitates a locking action to better retain articles inside the container.

U.S. Pat. No. 3,668,796, entitled "Combination Greeting Card and Three-Dimensional Ornament", discloses a greeting card that folds flat for mailing and can be folded into a three-dimensional ornament for decorative purposes. The blank from which the ornament is made is generally rectangular and none of the fold lines are arcuate. The resulting article is a polyhedron, made up of many flat sides and straight edge corners.

None of the above-described references teach or suggest the construction of the present invention which provides significant advantages. None provides a three-dimensional, folded engineered structure which is sphere-like with integrally-formed structural ribs having the aesthetically pleasing shape of the present invention.

SUMMARY OF THE INVENTION

The present invention has been devised to overcome the failings of the prior art constructions and paper ornaments described above. This has been achieved by incorporating both structural and ornamental qualities into a single, integrated construction. The construction of the present invention is made from a single, die-cut, nearly rectangular blank of flat, foldable material which is pre-creased in a unique configuration which defines the fold lines. The completed structure is characterized by a convex dome shape on at least the top side. The construction may take the form of a very solid, somewhat spherical, sculptured appearance by using two opposing dome shapes, preferably sharing the same axis. Each dome is radially sectioned in an equal pattern around the axis of the dome, and each section of the dome includes a recessed portion which interrupts the outer skin, performing arched extensions of the outer skin between each recess. The resulting construction is extremely strong, and as will be described in more detail below, the fold pattern is extremely simple.

The blank of material from which the construction is made is nearly rectangular having top, bottom, and right and left side edges. The top and bottom edges have successive peaks and valleys forming a gentle saw-tooth configuration. Right and left side edges fall along straight vertical lines, except for tabs along one side edge to facilitate affixation between the opposing side edges. The blank further includes a plurality of arch-shaped top and bottom fold lines, which are preferably scored and arranged side by side along both top and bottom edges. The base of each arch falls along the edge of the blank with the apex of each arch being directed inward toward the center of the sheet. The sides of the arches meet and terminate along the top and bottom edges, at points on the peaks. These curved fold lines are supplemented by straight, vertical fold lines which internally bisect each arch shape and are folded in the opposite direction of the curved fold lines. The vertical fold lines connect the apexes of each arch with the valleys along both the top and bottom edges. The top and bottom fold lines are horizontally offset so that the peaks of the top edge are in vertical alignment with the valleys of the bottom edge. The symmetry or asymmetry of the completed form is dependent on whether the top and bottom fold lines are symmetrical or asymmetrical with each other.

The construction is formed by first joining right and left side edges of the blank to form a cylinder, so that the straight fold lines are able to fold inwardly. Then, the top and bottom openings are closed by folding the material inward along the above-described fold lines. The result is a somewhat spherical-shaped, solid three-dimensional construction which displays superior structural strength and an aesthetically pleasing curved surface. All portions of the outer surface of the completed construction comprise curved surfaces. There are no flat surfaces or straight edges, thereby contributing to the smooth, flowing, and aesthetically pleasing nature of its shape, as well as its innately superior structure.

A critical feature of the invention and the significant advancement over the prior art is the durability and strength of the completed structure. When folded, the top and bottom edges of the blank fall along the vertical axis between the domes and abut opposing folded edges to form interlocked triangular structural ribs. The ribs interlock against each other under co-mutual compression when held in their completed position, such as by using an adhesive. In an alternative embodiment, a support block may be used between the opposing structural ribs of the top and bottom domes. The addition of this block adds to the compression strength of the structure along the axis of the domes and may further provide additional surface area for applying the adhesive to hold the blank in its folded state.

It is therefore the primary object of the present invention to produce a three-dimensional structure from a single sheet of foldable material which provides dome shape with integrally-formed structural ribs supporting the outer surface of the structure.

It is a further object of the present invention to provide an ornamental construction which is sphere-like and is folded from a single sheet of flat material and which includes opposing, but preferably radially misaligned, structures with integrally-formed structural ribs.

It is yet another object of the present invention to provide a strong and damage-resistant folded paper ornament with unique sculptural and artistic appeal.

It is yet a further object of the present invention to create a folded paper ornament that is so superior in integrating its structural design and its artistic appeal that it can compete with more sophisticated ornaments in the marketplace which are made of glass, wood or metal.

Other objects, advantages and novel features of the invention will become apparent from the following detailed description of the invention when considered in conjunction with the accompanying drawings.

DESCRIPTION OF THE PREFERRED EMBODIMENT

Figure 1:
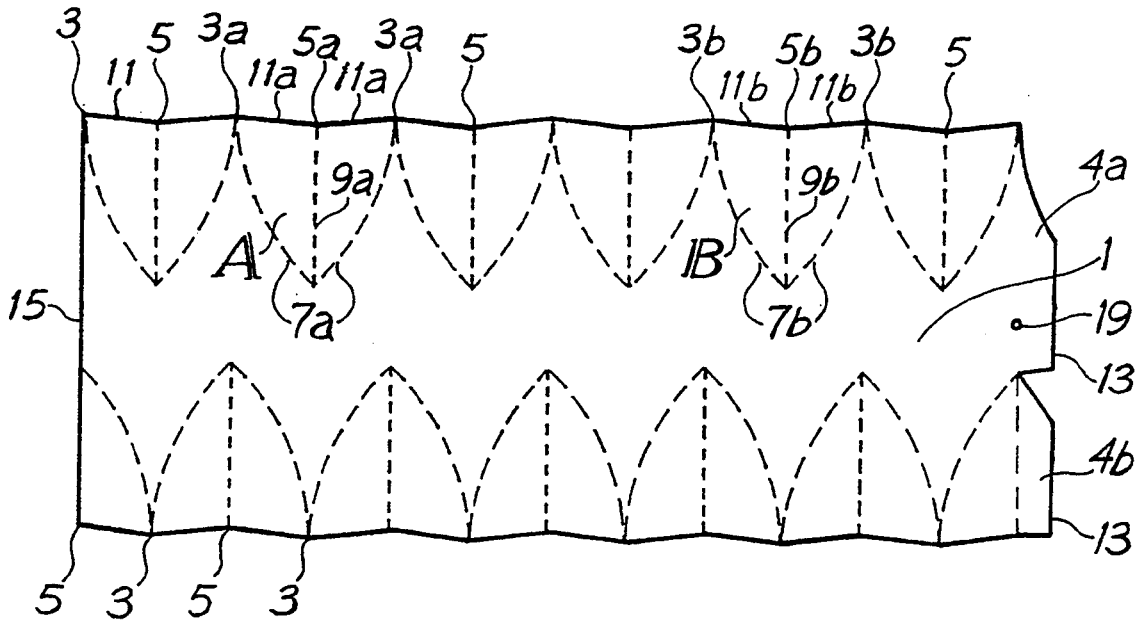
FIGS. 1 through 5 illustrate the configuration of the blank of the present invention and its folding sequence to form a completed structure.

Referring now to FIG. 1, the unfolded blank 1 of one embodiment of the present invention is shown. Top and bottom edges include successive peaks and valleys 3 and 5 respectively which form a gentle saw-tooth configuration along both edges. Left and right side edges 15 and 13 are vertical and straight. Edge 13 is interrupted by shapes that form two closure tabs, 4*a* and 4*b*, and hole 19 is located appropriately for attaching a hang string.

A plurality of arch-shaped fold lines are arranged along both edges with the fold lines along the bottom being symmetrical to those at the top, except offset a horizontal distance equivalent to one-half the width of each arch shape. The arches are arranged side-by-side and the curved fold lines which represent the sides of the arches terminate along each edge at the peaks 3. In addition, a plurality of vertical fold lines within each arch shape fold run between the peak of each arch apex and the valley along the opposing edge. All dotted lines which represent fold lines in FIG. 1 are creased in order to aid folding, so that vertical fold lines are encouraged to fold in the opposite direction from curved fold lines.

These fold lines may be described more specifically regarding the arch shapes A and B which appear along the top edge 11 of the blank in FIG. 1 . Arch shape A is comprised of curved lines 7*a* which fall along the top edge between successive peaks. Vertical fold line 9*a* travels between the apex of the arch shape and the valley along the top edge, which is equidistant between the peaks 3*a* where curved lines 7*a* terminate. Edge segments 11*a* connect valley 5*a* with each peak 3*a*. Similarly, with regard to arch shape B, curved lines 7*b* and vertical fold line 9*b* are likewise arranged between peaks 3*b* and valley 5*b*, and edge segments 11*b* run between the peaks and valleys at the base of arch shape B. While other fold lines may be pre-creased, the vertical fold lines are preferably perforated to provide an inward bias to the folding of each recess. Further clarity will be given to the invention with regard to these particular arch shapes A and B of blank 1 with reference to FIG. 7 discussed below.

Figure 2:
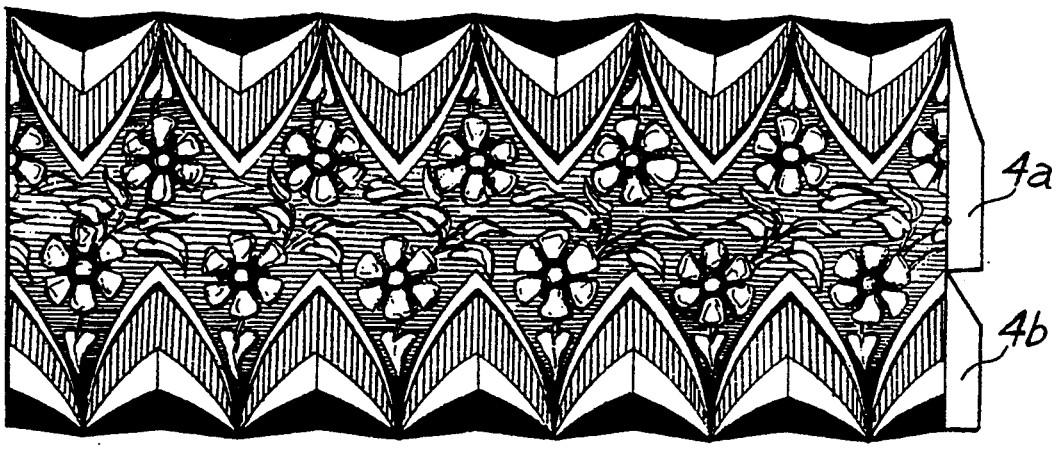

FIG. 2 shows the blank of FIG. 1 which has been decorated with representative graphic artwork that would be an optional version of the invention used as a decorated ornament.

Figure 3:
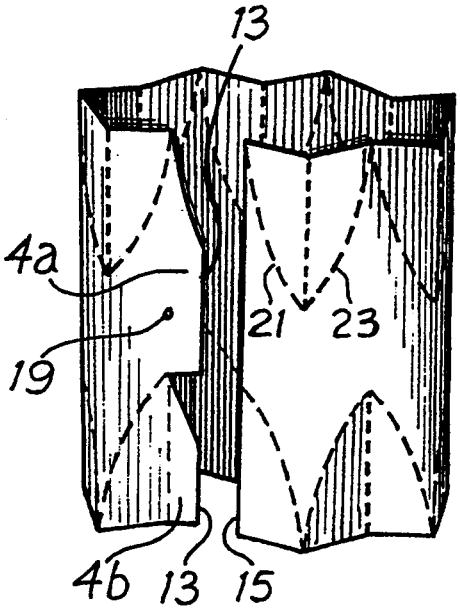
Figure 4:
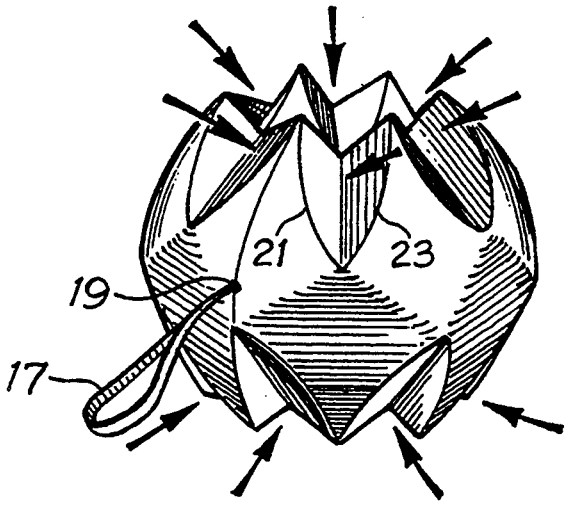
Figure 5:
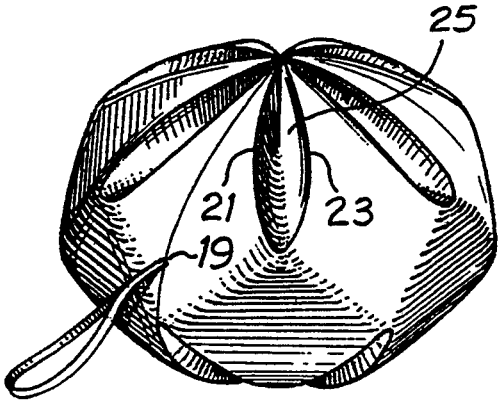

FIGS. 3, 4 and 5 show a folding sequence in which the blank of FIG. 1 is first folded into a cylinder by overlapping edge 13 with edge 15 and joining, thereby externally concealing, tabs 4*a* and 4*b*. At this point, hang string 17 may be fastened through hole 19 as depicted in FIG. 4. As further shown in FIG. 4, the cylinder may then be folded inward at the top and bottom along the direction of the arrows. FIG. 5 shows the ornament completely folded. By following the sequence of these folding steps, it can be seen, for example with regard to the arch-shaped fold lines 21 and 23 shown in FIG. 3, how these lines carry through between steps in the transformation during folding to eventually form the top edges of recess 25 of FIG. 5.

Figure 6:
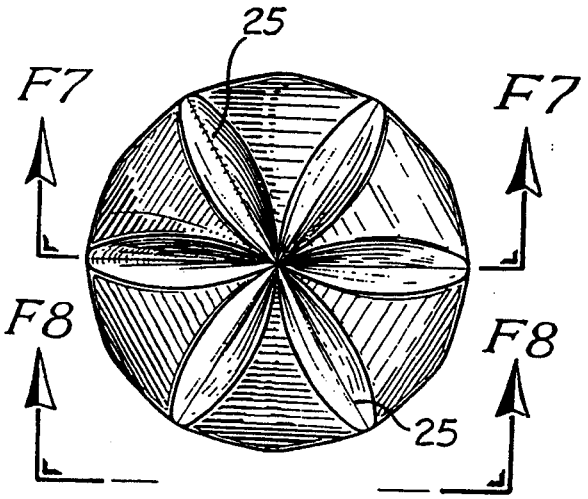
FIG. 6 is a top view of the ornament shown in FIG. 5.
Figure 7:
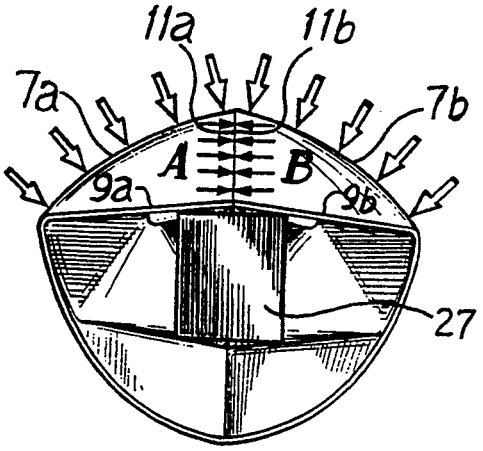
FIG. 7 is a cross-sectional view taken from FIG. 6 as shown in that figure. It also diagrammatically illustrates force vectors showing how compressive forces applied to the outer skin of the dome are transmitted to the dome axis by the structural ribs.
Figure 8:
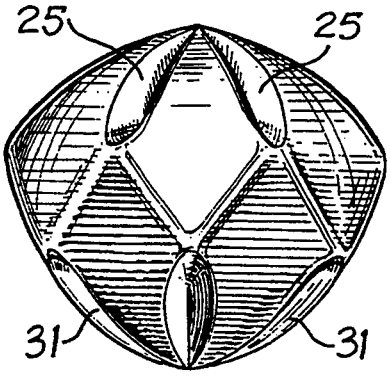
FIG. 8 is a side elevation of the ornament of the present invention shown in FIG. 5.

FIG. 6 is a view of the ornament shown in FIG. 5. A sectional view taken from this figure through the recesses 25 is shown in FIG. 7. With reference again to FIG. 1, arch shapes A and B are shown in that figure and are also depicted in FIG. 7. As seen in FIG. 7, the curved fold lines 7*a* and 7*b* first shown in FIG. 1 fall along the top of the spheroid-like shape and after folding, the resulting shapes lock into position forming abutting structural ribs. Edge segments 11*a* and 11*b* shown in FIG. 1 fall along the axis of the top dome and vertical fold lines 9*a* and 9*b* shown in FIG. 1 likewise fall into the positions shown in FIG. 7. The arrows represent vector forces which illustrate how forces against the outer skin of the folded shape are transmitted via the structural ribs into mutually-opposing compressive forces in the center of the dome shape along its vertical axis. As further shown in this figure, the invention may also include central support block 27 which provides additional structural rigidity along the axis of the structure. FIG. 8 is a side view of the structure shown in FIG. 6 and illustrates how the offset fold lines shown in FIG. 1 create offset top and bottom recesses 25 and 31 respectively.

Figure 9:
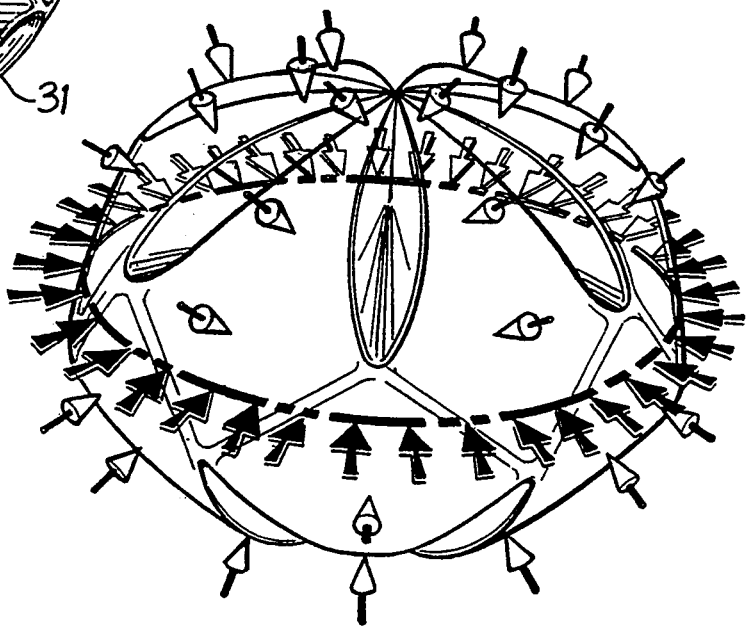
FIG. 9 is a perspective diagrammatic view illustrating how the compressive loads applied to the dome-like surfaces of the outer skin are transferred to the major circumference which forms a tension ring.

Referring now to FIG. 9, the great structural rigidity of the folded structure as shown in FIGS. 5 and 6 may be further appreciated with regard to this drawing. It is a surprising and unique characteristic of this folded structure that the greatest diameter of the shape through its mid-section represents a perfect circle. The material along this line forms a tension ring to provide inwardly-directed support to the outer skin of the construction in general, but more importantly to the outer ends of the structural ribs depicted more clearly in FIG. 7.

Figure 10:
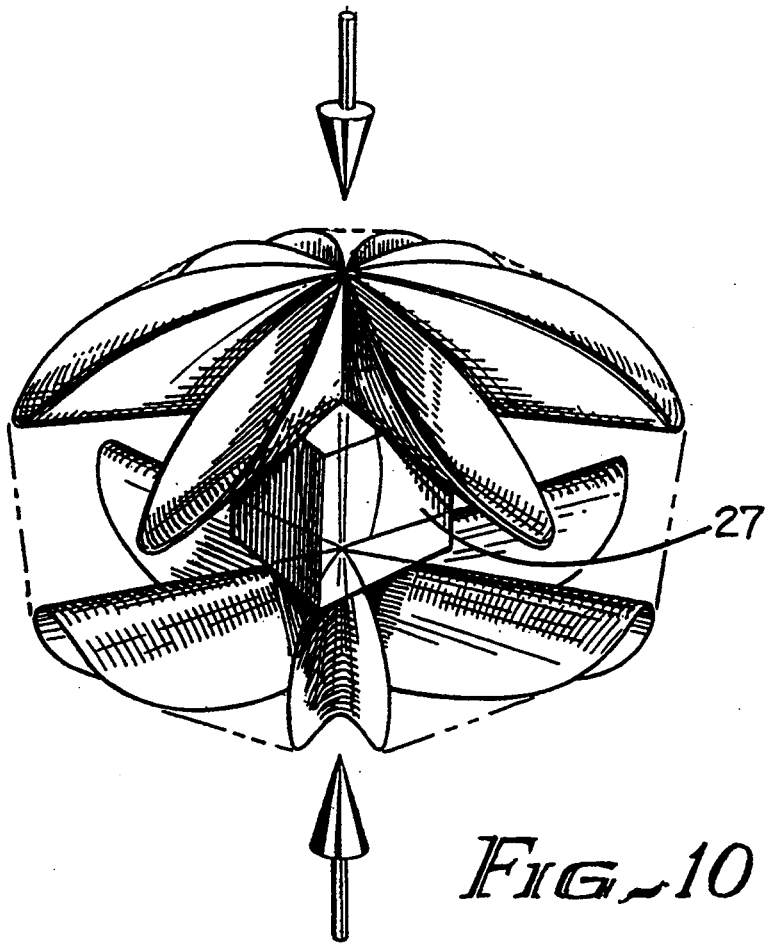
FIG. 10 is a perspective diagrammatic view of structural rib arrays and central support block with the outer skin shown in phantom.

Referring now to FIG. 10, the perspective diagrammatic drawing shows the opposing structural rib arrays, by removing the visual obstruction of the outer skin. It shows how the angles of the recesses converge and abut at the vertical axis, interlocking into an integrated radial structure. It also shows an embodiment which utilizes a centrally-positioned internal support block. Great axial compression resistance is provided between the opposing top and bottom domes utilizing this additional internal structure.

Figure 11:
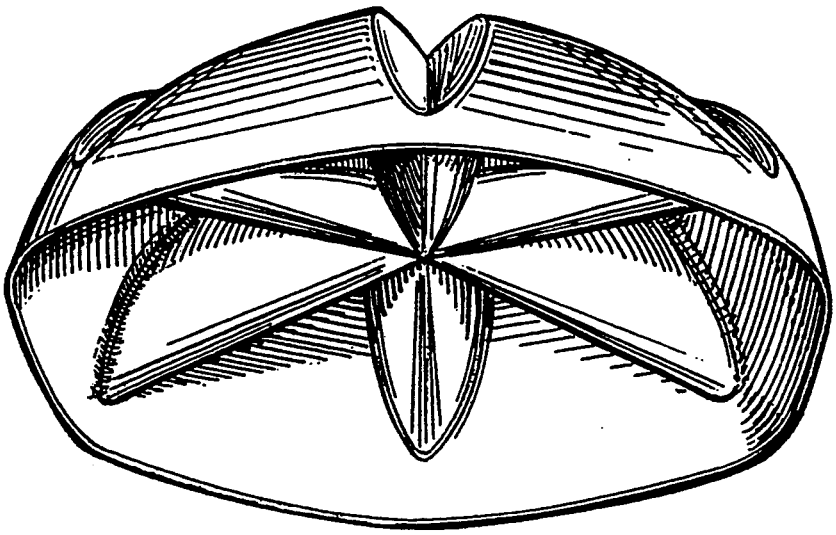
FIG. 11 is a perspective view, looking under a single dome structure, illustrating the radial pattern of the structural rib system.
Figure 12A:
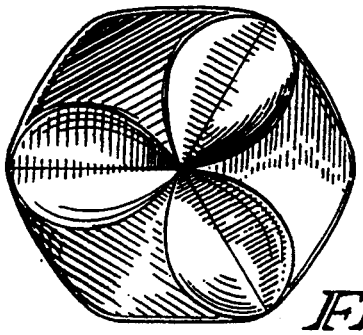
FIGS. 12*a* through 15*b* are top and perspective views of the present invention in its spheroid-like form showing the use of different numbers of recesses.
Figure 12B:
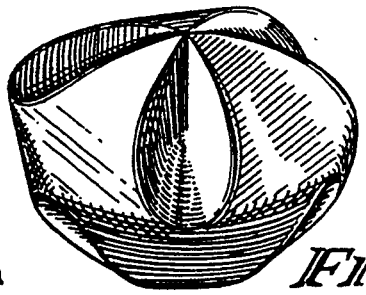
Figure 13A:
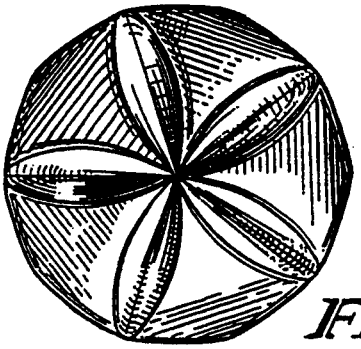
Figure 13B:
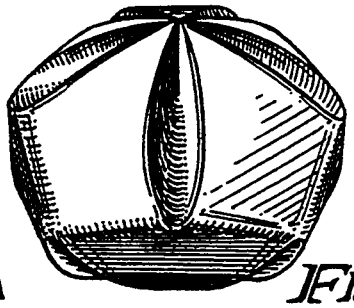
Figure 14A:
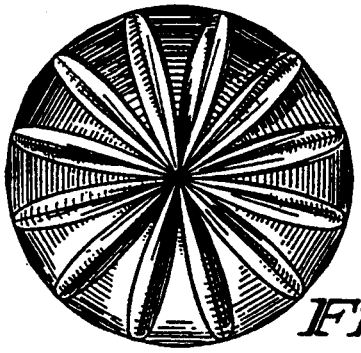
Figure 14B:
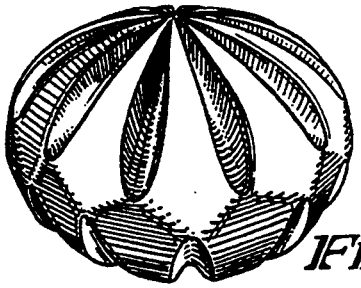
Figure 15A:
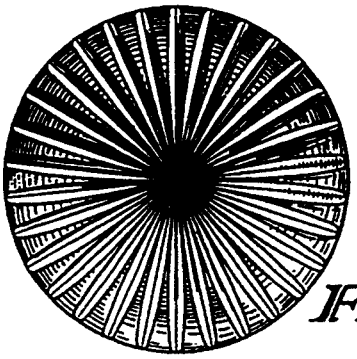
Figure 15B:
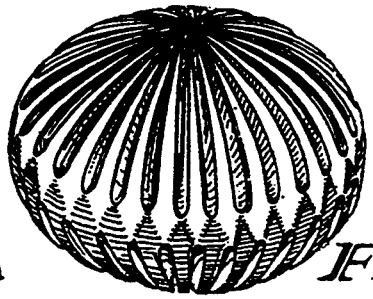

FIG. 11 illustrates an alternate embodiment of this invention which may be constructed by merely eliminating the folding along the bottom edge of the blank shown in FIG. 1. When formed into a cylinder and then folded along the top edge, a structurally very strong dome-like structure will be formed having straight, somewhat cylindrical sides. This shape may be useful as a building structure.

Although FIG. 1 depicts a folding pattern which yields six recesses in the top and bottom domes, different numbers of recesses may be chosen for appearance or greater structural strength. FIGS. 12*a* through 15*b* demonstrate representative shapes and appearances achieved by multiplying the number of arch-shaped fold lines.

According to the above descriptions of the invention, it should be apparent that the various objects of the invention have been achieved. Strong and durable shapes can be constructed of various materials and may range in size from the very small, which can include items such as hanging ornaments and personal jewelry, to very large structures such as buildings.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A blank of foldable material, comprising:

a flat, substantially rectangular, blank of foldable material having top, bottom, left and right side edges;

said top edge having peaks and valleys joined by straight lines forming a saw-tooth configuration;

a plurality of fold lines, comprising a plurality of identical arch-shaped lines and a plurality of straight vertical lines, said arch-shaped fold lines arranged side by side with the sides meeting and terminating at points on the peaks of said top edge, said straight vertical fold lines connecting the apexes of said arched shapes and the valleys along the top edge between the sides of the arches; and whereby joining the right and left side edges to first form a cylinder and then folding the top edge inward along said fold lines, forms a dome at the top having integrally-formed support ribs which abut end to end and are thus interlocked under comutual compression when downward forces are applied to the surfaces of said dome.

2. The blank of claim 1, further including a plurality of arch-shaped fold lines along the bottom edge, identical to the fold lines along the top edge, said bottom fold lines being horizontally offset from said top fold lines one-half the distance between successive peaks along the top edge, whereby folding the bottom edge along said bottom fold lines creates a second opposing dome and forms a closed, spherical-like structure composed entirely of arcuate surfaces.

3. The blank of claim 1, further including graphic indicia which are printed on said blank.

4. A spheroid-like enclosed structure, comprising:

a flat, substantially rectangular, blank of folded material having top, bottom, left and right side edges;

a plurality of fold lines, comprising a plurality of identical arch-shaped lines and straight vertical lines, said arch-shaped fold lines arranged side by side and said straight vertical fold lines internally bisecting each of said arch shapes, said fold lines arranged along both top and bottom edges with the fold lines along said bottom edge horizontally offset by one-half the width of said arch shapes;

whereby joining the right and left side edges to first form a cylinder, and then folding the top and bottom edges inward along said fold lines forms a spherical-like shape having opposing domes at the top and bottom, said shape made up entirely of arcuate outer surfaces.

5. The structure of claim 4, wherein said blank is made of paper.

6. The structure of claim 4, wherein said curved fold lines are pre-creased and said vertical lines are perforated to facilitate folding.

7. The structure of claim 6, further including an internal support block positioned along the vertical axis of said spheroid shape.

8. The structure of claim 7, wherein the blank is made of paper and the structure is an ornament.

9. A dome structure made from foldable material, comprising:

a flat, substantially rectangular, blank of foldable material having top, bottom, left and right side edges;

said top edge having peaks and valleys joined by straight lines forming a saw-tooth configuration;

a plurality of fold lines, comprising a plurality of identical arch-shaped lines and a plurality of straight vertical lines, said arch-shaped fold lines arranged side by side with the sides meeting and terminating at points on the peaks of said top edge, said straight vertical fold lines connecting the apexes of said arched shapes and the valleys along the top edge between the sides of the arches; and whereby joining the right and left side edges to first form a cylinder and then folding the top edge inward along said fold lines forms a dome at the top having integrally-formed support ribs which abut end to end and are thus interlocked under comutual compression when downward forces are applied to the surfaces of said dome.

* * * * *